United States Patent [19]

Roberts

[11] Patent Number: 4,967,722

[45] Date of Patent: Nov. 6, 1990

[54] ARROW REST SUPPORT FOR ATTACHMENT TO AN ARCHERY BOW

[75] Inventor: Kent S. Roberts, American Fork, Utah

[73] Assignee: Roberts Mfg., Inc., American Fork, Utah

[21] Appl. No.: 332,883

[22] Filed: Apr. 3, 1989

[51] Int. Cl.[5] ..... F41B 5/00

[52] U.S. Cl. ..... 124/44.5; 124/24.1

[58] Field of Search ..... 124/41 H, 24 R

[56] References Cited

U.S. PATENT DOCUMENTS

| | | | |
|---|---|---|---|
| 2,725,870 | 12/1955 | Pfeiffer | 124/41 A |
| 3,672,347 | 6/1972 | Allen | 124/41 A |
| 3,760,788 | 9/1973 | Hartman | 124/41 A |
| 3,769,956 | 11/1973 | Simo . | |
| 3,865,096 | 2/1975 | Troncosco, Jr. . | |
| 3,890,951 | 6/1975 | Jennings et al. . | |
| 3,935,854 | 2/1976 | Troncosco | 124/41 A X |
| 4,054,119 | 10/1977 | Hansen et al. | 124/41 A X |
| 4,064,863 | 12/1977 | Helmick | 124/41 A |
| 4,074,674 | 2/1978 | Simo . | |
| 4,380,226 | 4/1983 | Saunders | 124/41 A |
| 4,548,188 | 10/1985 | Simo . | |
| 4,608,959 | 9/1986 | Seynaeve | 124/41 A X |
| 4,748,964 | 6/1988 | Troncosco, Jr. . | |

*Primary Examiner*—Peter M. Cuomo

*Attorney, Agent, or Firm*—Mallinckrodt & Mallinckrodt

[57] ABSTRACT

An arrow rest support comprises an arrow support member having an elongate and hollow structure open from end-to-end along an upper portion of its length to provide a cradle-shaped arrow rest, which rigidly supports the arrow vertically against the force of gravity and semi-rigidly horizontally. Such member has sufficient open space to allow the fletching of the arrow to pass without impediment. The arrow rest support also comprises an attachment arrangement for adjusting the space between the bow handle and the arrow rest. The arrow support member is preferably molded from a medium density plastic material, such as a medium density polyethylene in a general box beam configuration having a rectangular cross section, but open along an upper elongate corner as a gap between arrow rest surfaces.

14 Claims, 1 Drawing Sheet

ARROW REST SUPPORT FOR ATTACHMENT TO AN ARCHERY BOW

BACKGROUND OF THE INVENTION

1. Field:

The invention is in the field of arrow rest supports for archery bows.

2. State of the Art:

It is customary to provide some means for supporting the shaft of an arrow in the window portion of an archery bow during launch. One such support that is sometimes used is the lower ledge of the window. window. However, this does not provide a passaway for the arrow fletching during and also does not normally provide means to prevent roll-off of the arrow.

The impact of the arrow fletching against the handle of the bow is minimized to some extent by the effect known as "archer's paradox", wherein the force of the bowstring against the end of the arrow launch causes the arrow to bow slightly such that the fletching is at least partially moved away from the bow handle. However, this is only partially effective to avoid striking of the fletching against the bow and also itself affects the accuracy of the arrow's flight.

In order to minize these difficulties, an arrow rest support, separate from but attachable to the bow, is often employed to provide resiliency between the points of contact of the arrow shaft with the support. These points of contact are usually spoken of as "the arrow rest". The resiliency reduces the amount of archer' paradox and also softens any impact of the fletching against the arrow rest.

Additionally, some arrow rest supports provide rest means which at least partially cradles the shaft of the arrow so as to protect roll-off.

SUMMARY OF THE INVENTION

The arrow rest support of the invention comprises a simple arrow support member provided with attachment means for adjustably attaching it to the bow handle. The arrow support member provides arrow rest means substantially rigid in the vertical direction and semi-rigid in the horizontal direction, along with open space through which the arrow fletching can pass without striking either the support or the bow handle. The arrow rest is also cradle-shaped to protect against roll-off.

The arrow support member of the arrow rest support is an elongate, hollow structure open an upper portion of its length and preferably unitarily molded from a suitable plastic material, such as a medium density polyethylene. It is advantageously shaped in the form of a box beam having a rectangular cross section but in which the upper portion of the outermost side wall and the outer portion of the top wall are not joined together to form a corner, as in the usual box beam, but, instead, have a gap between them, and are formed to provide two cooperative surfaces serving as the arrow for supporting the shaft of an arrow in the gap therebetween. The outermost side wall tapers upwardly and forwardly from bottom to top over a portion of its length. The top wall tapers forwardly and outwardly from the rear toward the front over a corresponding portion of its length. Thus, surface portions of the walls, which contact and support the arrow rest means, are of reduced longitudinal dimension. Additionally, the upper edge of the outermost wall is beveled downwardly and inwardly across its width, thus providing a cradle in which the shaft of the arrow can partially nestle. This serves to protect against roll-off of the arrow.

The dimensions of the arrow support member are such that the downwardly extending portions of the arrow fletching can pass unimpeded, without striking any portion of the arrow rest support. In addition, in one embodiment of the invention, the attachment means for attaching the arrow rest support to the bow handle is adjustable, such that the arrow rest can be aligned with the bow string, and is also spaced away from the bow handle so as to allow upwardly and inwardly extending portions of the arrow fletching to pass unimpeded, without striking any portion of the bow handle.

This spacing from the bow handle also contributes to the achievement of horizontal resiliency, which results primarily from (1) the forming of the arrow rest support from a resilient or a semi-rigid material, such as a medium density polyethylene, (2) by controlling and reducing stiffness of the innermost wall by utilizing an appropriate thickness for the wall, (3) by providing a vertical slot in the innermost wall just forwardly of the arrow rest and extending at least part way from the top toward the bottom of the wall, and (4) by providing space between the innermost wall and the bow handle. Thus, as the arrow is launched, the arrow rest can move transversely to some extent, thus softening the shock of launch and reducing the archer's paradox effect.

The arrow support member of the arrow rest support is attached to the bow at one side thereof and in the window portion of the bow handle advantageously by means of a single screw, which passes through a transverse hole in the innermost sidewall of the support and screws into the internally threaded end of an externally threaded bushing that, in turn, is threaded into an internally threaded insert that is pressed into bow handle. The axial length of the bushing is greater than the thickness of the bow handle, so as to protrude toward the arrow rest support a greater or less distance by screwing the bushing one way or the other in the insert, so as to adjust the spacing of the arrow support relative to the bow. A lock washer is preferably inserted between the inner end of the bushing and the arrow rest support, and a nut is threaded on the outer end of the bushing for tightening against the bow handle.

THE DRAWINGS

Embodiments representing the best modes presently contemplated for carrying out the invention are shown in the accompanying drawings, in which:

FIG. 1 is a sede elevational view of one embodiment of the arrow rest support attached to a bow handle that, together with the shaft of an arrow, is shown fragmentarily by broken lines;

FIG. 2, a rear elevational view of what is shown in FIG. 1, but with three feather fletching on the arrow and indicating how the device of the invention accomodates the fletching when the arrow is shot;

FIG. 3, a top plan view of the arrow rest support as seen from the line 3—3 of FIG. 1;

FIG. 4, a side elevational view of the arrow rest support taken from the standpoint of the line 4—4 of FIG. 2 and showing the opposite thereof to that shown in FIG. 1 and with hidden parts indicated by broken lines;

FIG. 5, an exploded view partially in section showing the method of attachment of the arrow support member to the bow handle; and FIG. 6, view largely corresponding to that of FIG. 2 but of a somewhat different embodiment showing the arrow rest support minus the bow and with arrow fletching having four feathers indicated by broken lines as accommodated by the arrow support member when the arrow is shot and with an alternate attachment means comprising two-sided adhesive tape.

DETAILED DESCRIPTION OF THE ILLUSTRATED EMBODIMENTS

Figure 1:
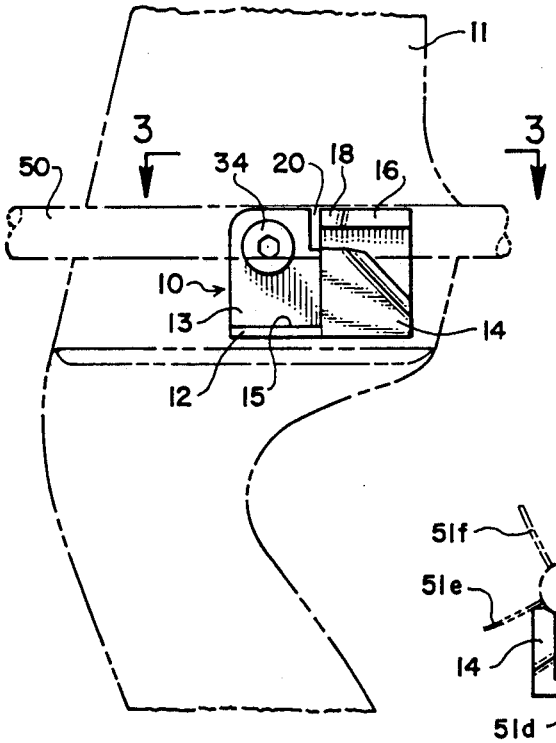

The arrow rest support of the invention is shown at 10 in FIGS. 1, 2, 3, and 5 attached in the window of the handle of a bow 11 that is indicated fragmentarily by broken lines.

Arrow rest support 10 comprises an arrow support member 12, which is an elongated hollow structure having an opening or gap 17 extending along an upper portion of its length from end-to-end thereof. It is preferably formed unitarily by molding a suitable plastic material, such as a medium density polyethylene, in a suitable die in accordance with standard molding techniques.

In the form shown, arrow support member 12 is advantegeously molded in the general shape of a box beam of rectangular cross section having an innermost side wall 13, an outermost side wall 14, a bottom wall 15, and a top wall 16. Top wall 16 and outermost wall 14 are both foreshortened so that they do not meet in a corner, as in the usual box beam, but are spaced by the gap 17 to form an arrow rest. The upper edge surface of outermost side wall 14 and the outer edge surface of top wall 16 form a cradle to receive and support the shaft of an arrow. Gap 17 has a dimension which is somewhat less than the diameter of the arrow, so as to preclude the arrow from falling into the interior of the arrow support member 12.

Figure 5:
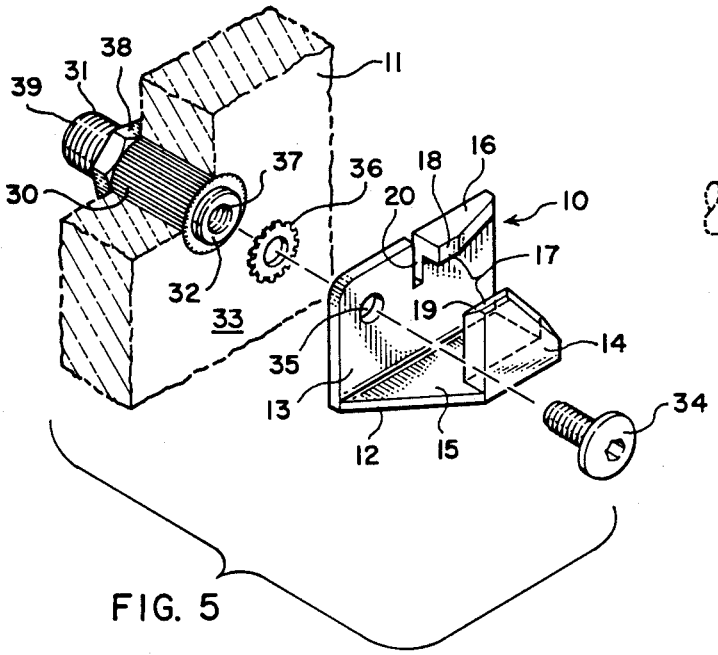
Figure 3:
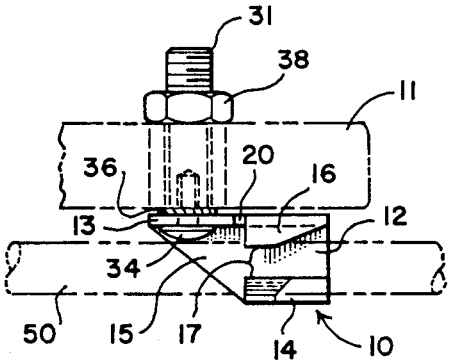

Referring to FIGS. 3 and 5, it can be seen that the top wall 16 and outermost wall 14 are also foreshortened longitudinally such that the forward portion of member 12 has only a bottom wall 15 and an innermost wall 13. In addition, bottom wall 15 may truncated as shown, all in the interest of conserving material.

In addition, top wall 16 is tapered forwardly and outwardly from its rear to its front, along the greater part of its length, as shown best in FIGS. 3 and 5. Also, outermost wall 14 is tapered forwardly and upwardly from its bottom to its top, along a corresponding part of its length. Thus, the surface 18 of top wall 16, against which the arrow shaft rests, is much reduced in length. The same is true for surface is 19 of outermost wall 14. Furthermore, surface 19 is beveled so as to slope inwardly and downwardly across its width, thus enhancing the cradle aspect of gap 17. Additionally, outermost wall 14 is made somewhat thicker than the other walls, thus increasing the width of the beveled edge. These features serve to protect against fall off of the arrow when being readied for launch.

Figure 4:
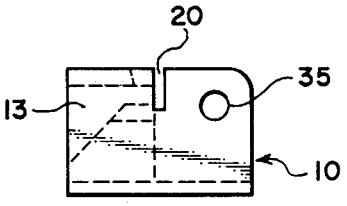

As noted previously, the material chosen for member 12 is a moldable material, such as polyethylene. The particular formulation chosen is preferably one of medium density so as to have a resultant rigidity somewhat less than than that of a hard high density material but more than that of a soft low density material. The rigidity is great enough that the arrow rest cradle formed by surfaces 18 and 19 will not open up so far in use as to allow the arrow to fall therebetween. At the same time, the rigidity is low enough so as to provide some resilience or flexing of the surface 18, thus reducing the effect of launch shock or archer's paradox. The resilence is also partially determined by selecting a proper thickness, e.g. approximately 3/32 inch, for innermost wall 13. This resilience is further enhanced by slot 20, shown in FIGS. 1, 4, and 5, which is formed in the upper portion of innermost wall 13, extending at least part way towards the bottom of the wall.

Figure 2:
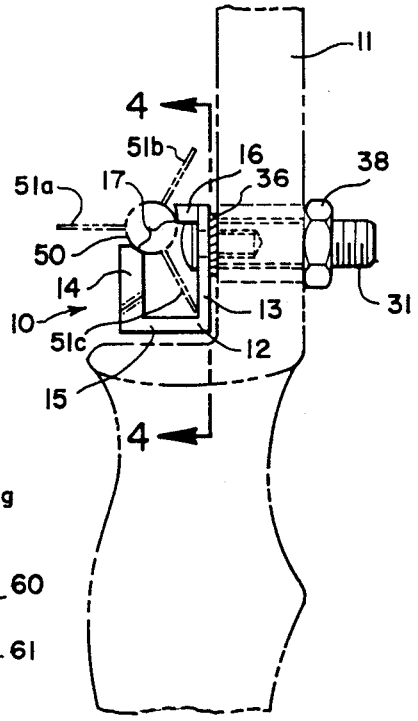

The internal dimensions of the box are such, e.g. approximately 9/16 inch deep by 5/16 inch wide, that the arrow fletching can pass the arrow rest when launched without striking any portion of the arrow support member. An arrow shaft 50 with three fletch feathers **51*a*, 51*b*, and 51*c* is shown in FIG. 2. As shown, the fletching is oriented such that fletch feathers 51*a* and 51*b* pass outside box beam 12 and fletch 51*c* passes through the internal space in box beam 12**.

Figure 6:
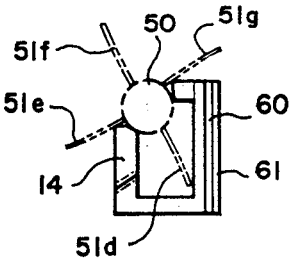

A four fletch feather arrow having its shaft resting on the arrow rest is shown in FIG. 6. In this version, fletch feather **51*d* passes through the internal space in box beam 12 and fletch 51*e*, 51*f*, and 51*g* pass outside box beam 12**.

Arrow support member 12 is attached to bow handle 11 by means best shown in FIG. 5. Bow handles normally have an internally threaded insert 30 pressed into a transverse hole. However, if an insert is not provied then one is inserted. An externally threaded bushing 31 is then threaded into insert 30. Bushing 31 has a length somewhat greater than the thickness of bow handle 11, and is inserted such that end 32 protrude beyond face 33 of bow handle 11 sufficiently as to provide a desired spacing between bow handle 11 and arrow support member 12. A screw 34 is then inserted through a transverse hole 35 in the innermost wall 13 of arrow support member 12, then through a lock washer 36, and then threaded into an internally threaded axial bore hole 37 in the end 32 of bushing 31. A nut 38 is then threaded onto end 39 of bushing 31 and tightened against bow handle 11. Additionally, screw 34 is tightened. Thus, arrow support member 12 is held firmly attached to bow handle 11 at the desired spacing.

An alternative mounting means may be employed which eliminates the necessity for inser 30, bushing 31, screw 34, lockwasher 36, and nut 38. Arrow support member 12 may be simply glued to bow handle 11. Or, alternatively, a tape 60, as shown in FIG. 6, with adhesive on both may be affixed to the outer face of innermost wall 13. The tape normally be applied to the arrow support member at the factory with a peel-off protective covering 61 over its outer other face, which would be peeled off by the user when affixing the arrow support member to the bow handle. This alternative is simplier and less costly but does not provide means for adjustably spacing the arrow rest from the bow handle.

Whereas this invention is here illustrated and described with specific reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

I claim:

1. An arrow support member for attachment to an archery bow, comprising an elogate, unitary, and hollow structure open from end-to-end along an upper portion of its length forming a gap and providing cooperative surfaces that serve as an arrow rest, said structure having a generally box beam configuration of rectangular cross section along at least a portion of its length with a top wall, bottom wall, and side walls, one of said side walls and the top wall not being joined to form a corner but, instead, being forshortened so as to leave a gap therebetween, the upper edge surface of said one side wall and the adjacent edge surface of said top wall cooperating to form said arrow rest for an arrow shaft.

2. An arrow rest support in accordance with claim 1, wherein the width of the gap is less than the diameter of the shaft of the arrow to be used.

3. An arrow rest support in accordance with claim 2, wherein the walls supporting the arrow rest surfaces are sufficiently rigid to prevent the force exerted on them by laucnh of an arrow from widening the gap so far as to allow the shaft of the arrow to fall therethrough.

4. An arrow rest support in accordance with claim 1, wherein the one side wall of the box beam is tapered longitudinally and upwardly from its bottom towards its top at least a portion of its length, wherein the top wall of said box beam is tapered longitudinally and outwardly along at least a portion of its length, and wherein the portions of said one side and said top walls that are not tapered provide the cooperative surfaces that serve as the arrow for an arrow shaft.

5. An arrow rest support in accordance with claim 4, wherein the upper edge surface of the one side wall which supports the arrow rest is beveled inwardly and downwardly across its width.

6. An arrow rest support in accordance with claim 1, wherein the cross sectional dimensions of the box beam are such to provide open space through which lower fletching of the arrow can pass without striking the arrow support member.

7. An arrow rest support in accordance with claim 1, wherein the other side wall of the box beam is less thick than the one side wall.

8. An arrow rest support in accordance with claim 1, wherein the other side wall of the arrow support member has a substantially vertically disposed elongate slot that extends from the top of said wall at least part way to the bottom of said wall so as to provide horizontal resiliency for the arrow rest.

9. An arrow rest support in accordance with claim 8, wherein the slot is located between the forward and rearward ends of the other side wall forwardly of the arrow rest.

10. An arrow rest support in accordance with claim 1, wherein the arrow support member is fashioned from a material having resiliency.

11. An arrow rest support in accordance with claim 10, wherein the material is a medium density polyethylene.

12. An arrow rest support, comprising an arrow support member in the form of an elongate, unitary, and hollow structure open from end-to-end along an upper portion of its length forming a gap, said structure having a generally box beam configuration of rectangular cross section along at least a portion of its length but wherein a top wall and an outermost wall of said box beam configuration are not joined to form a corner but, instead, are each foreshortened so as to leave a gap therebetween and provide cooperative surfaces that serve as an arrow rest, the upper edge of said outermost wall and the outer edge of said top wall providing said cooperative surfaces and forming an arrow rest which rigidly supports the shaft of an arrow against the force of gravity and semi-rigidly supports the shaft of said arrow horizontally; and means for attaching said arrow support member to an archery bow.

13. An arrow rest support in accordance with claim 12, wherein the attachment means comprises:

an internally threaded insert pressed into a transverse hole in the handle of the bow;

an externally threaded bushing which is longer axially than said threaded insert that is threaded into said threaded insert, and which has an internally threaded axial bore in one end thereof;

a screw which passes through a transverse hole in an innermost wall of said arrow rest support and which is threaded into said internally threaded axial bore in said bushing;

a lock washer interposed between the face of said innermost wall of said arrow rest support and the end of said threaded bushing; and a nut threaded onto said threaded bushing which serves to tighten said arrow rest support to said bow handle.

14. An arrow rest support in accordance with claim 12, wherein the attachment means comprises a thin strip of tape having adhesive on both sides, one side of said tape being affixed to an outer face of a side of the arrow support member and the other side of said tape having a protectible peel-off sheet affixed to it, which sheet can be peeled off at the time said arrow rest support is to be affixed to a bow handle.

* * * * *

UNITED STATES PATENT AND TRADEMARK OFFICE

CERTIFICATE OF CORRECTION

PATENT NO. : 4,967,722

DATED : November 6, 1990

INVENTOR(S) : Kent S. Roberts

It is certified that error appears in the above-identified patent and that said Letters Patent is hereby corrected as shown below:

Column 1, line 13, the second "window" should be deleted.
Column 2, line 53, "sede" should be "side".
Column 2, line 38, insert "the" between "into bow".
Column 3, line 53, delete "is" at its second occurrence.
Column 4, line 28, "provied" should be "provided"; line 32 "protrude" should be "protrudes"; line 45, "inser" should be "insert"; in line 50 insert "would" after "tape".
Column 5, line 7, "forshortened" should be "foreshortened"; line 18 "laucnh" should be "launch"; line 28 insert "rest" after the first occurrence of "arrow".

Signed and Sealed this

Seventh Day of April, 1992

*Attest:*

HARRY F. MANBECK, JR.

*Attesting Officer*

*Commissioner of Patents and Trademarks*